US011571044B2

(12) United States Patent
Murphy-Reinhertz et al.

(10) Patent No.: US 11,571,044 B2
(45) Date of Patent: Feb. 7, 2023

(54) LACING SYSTEMS AND METHODS OF MANUFACTURING THE SAME

(71) Applicant: NIKE, Inc., Beaverton, OR (US)

(72) Inventors: Noah Murphy-Reinhertz, Portland, OR (US); Haley L. Toelle, Portland, OR (US); James Zormeir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/471,710

(22) Filed: Sep. 10, 2021

(65) Prior Publication Data

US 2021/0401120 A1 Dec. 30, 2021

Related U.S. Application Data

(63) Continuation of application No. 16/831,680, filed on Mar. 26, 2020, now Pat. No. 11,129,445.

(51) Int. Cl.
*A43C 1/04* (2006.01)

(52) U.S. Cl.
CPC ..... *A43C 1/04* (2013.01)

(58) Field of Classification Search
CPC ..... A43C 1/04; A43C 11/004; A41F 1/00
See application file for complete search history.

(56) References Cited

U.S. PATENT DOCUMENTS 712,003 A * 10/1902 Payne ..... A43C 1/04 24/714.7
1,330,615 A 2/1920 Pierre
1,466,075 A * 8/1923 Triay, Jr. ..... A43C 5/00 24/713.2
2,369,254 A 2/1945 John
2,406,528 A * 8/1946 Blair ..... A41F 1/04 450/141
D163,019 S * 4/1951 Braun ..... D2/928
D163,360 S 5/1951 Braun
4,974,299 A 12/1990 Moon
D376,042 S * 12/1996 Cooper ..... D2/978
5,632,071 A * 5/1997 Maunder ..... A45F 5/02 24/DIG. 37
8,898,931 B2 * 12/2014 Gerber ..... A43C 1/04 24/714.7
2006/0005429 A1 1/2006 Min
2012/0174437 A1 7/2012 Heard
(Continued)

FOREIGN PATENT DOCUMENTS

FR 1 143 543 10/1957

OTHER PUBLICATIONS

International Search Report and Written Opinion, dated May 10, 2021, issued for International Application No. PCT/US2021/019049, 9 pages.

*Primary Examiner* — David M Upchurch
(74) *Attorney, Agent, or Firm* — Klarquist Sparkman, LLP

(57) ABSTRACT

Lacing systems for articles of apparel can include a first continuous lace element and a second continuous lace element, with each having a lace-receiving portion secured to the article of apparel, directly or indirectly, and a lacing portion that can engage with respective loop apertures of the lace-receiving portion to provide a closure mechanism. The articles of apparel can be articles of footwear and the lacing system can be provided to close an opening in an upper of the article of footwear.

20 Claims, 9 Drawing Sheets

(56) References Cited

U.S. PATENT DOCUMENTS

| | | | | |
|---|---|---|---|---|
| 2013/0086815 | A1 | 4/2013 | Toraya | |
| 2014/0130372 | A1 | 5/2014 | Aveni et al. | |
| 2016/0331083 | A1* | 11/2016 | Uesato | A43C 1/04 |
| 2016/0366980 | A1* | 12/2016 | Bell | A43C 1/04 |
| 2017/0202296 | A1 | 7/2017 | Fuerst, Jr. et al. | |
| 2017/0215523 | A1* | 8/2017 | Nishiwaki | A43B 23/0265 |
| 2021/0022447 | A1 | 1/2021 | Cobb | |

* cited by examiner

LACING SYSTEMS AND METHODS OF MANUFACTURING THE SAME

CROSS REFERENCE TO RELATED APPLICATION

This application is a continuation of U.S. patent application Ser. No. 16/831,680, filed Mar. 26, 2020, which is incorporated herein by reference in its entirety.

FIELD

This disclosure is directed to lacing systems for articles of apparel.

BACKGROUND

Articles of apparel can include lacing systems that provide and/or restrict access to an interior area of the article, enhance the performance of the article, and/or improve the comfort of a wearer. Continued improvements in lacing systems for articles of apparel are desirable.

DETAILED DESCRIPTION

Figure 1:
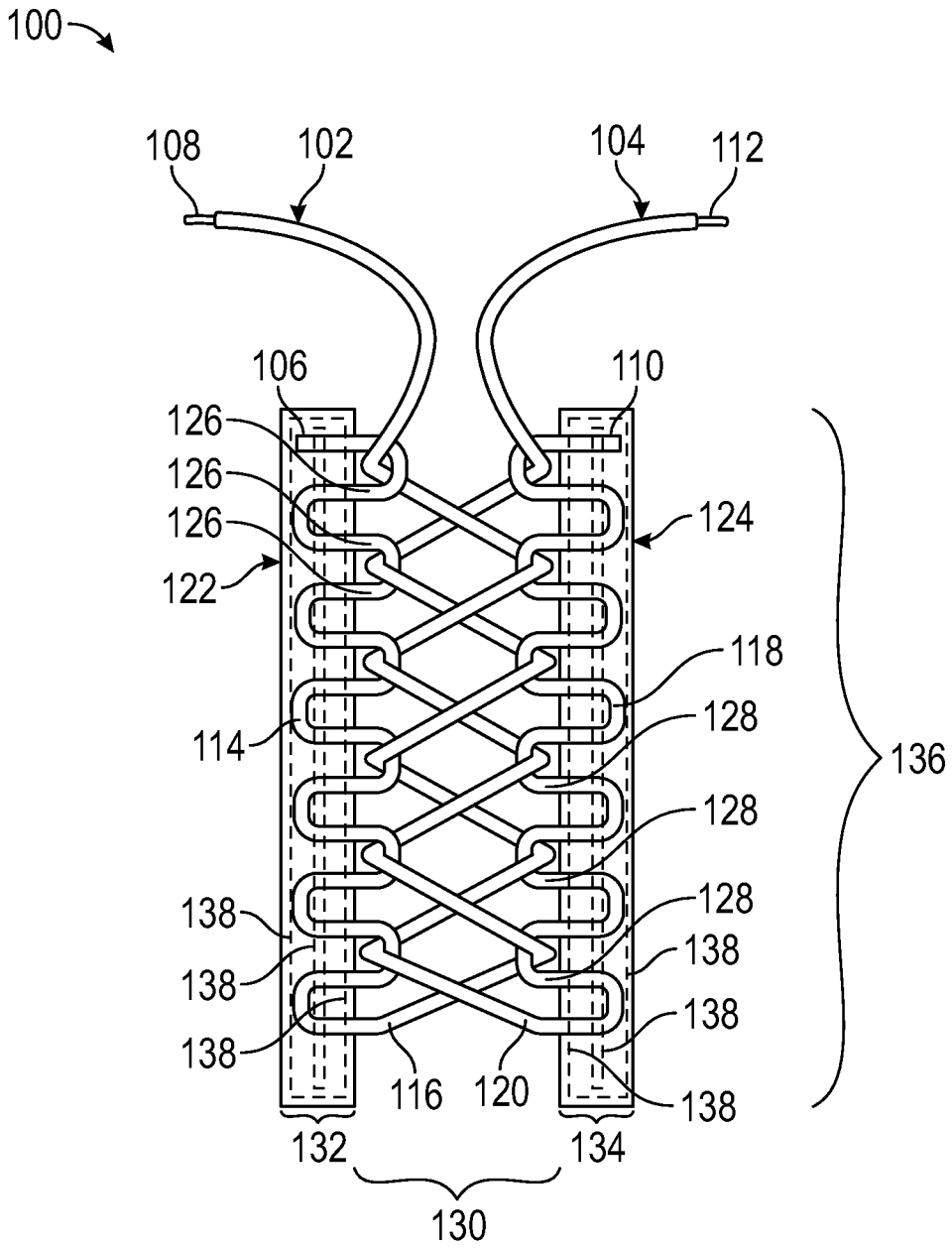
FIG. 1 illustrates an exemplary lacing system.

Disclosed herein are various embodiments of lacing systems and articles of apparel that include lacing systems, as well as methods of manufacturing and using such lacing systems.

In one embodiment, a lacing system for an article of apparel is provided. The lacing system includes a first continuous lace element having a first lace-receiving portion and a first lacing portion, a second continuous lace element having a second lace-receiving portion and a second lacing portion, a first carrier to which the first lace-receiving portion of the first lace element is fixedly attached, and a second carrier to which the second lace-receiving portion of the second lace element is fixedly attached. The second carrier is spaced apart from the first carrier by a lacing gap. The first lace-receiving portion forms a first plurality of loop apertures and the second lace-receiving portion forms a second plurality of loop apertures. The first lacing portion can engage with respective ones of the first plurality of loop apertures and respective ones of the second plurality of loop apertures, and the second lacing portion can engage with respective ones of the first plurality of loop apertures and respective ones of the second plurality of loop apertures.

The first and second plurality of loop apertures can form a plurality of pairs of loop apertures, such as at least two pairs of loop apertures or from two to ten pairs of loop apertures. The plurality of pairs of loop apertures can be symmetrically aligned along a length of the lacing system.

The first and second carriers can be formed from elongated strips of material that extend along first and second sides, respectively, of the lacing gap. In some embodiments, the first carrier and the second carrier can have a rectangular shape.

In some embodiments, the lace-receiving portions can be stitched to a respective carrier. Alternatively, or additionally, the lace-receiving portions can be adhesively bonded to a respective carrier.

The lacing systems can include an article of apparel, such as an article of footwear, and the first and second carriers can be secured to an external surface of the article of apparel. In some embodiments, the first carrier has a first top surface and a first bottom surface, and the first lace-receiving portion is secured to the first top surface (or, alternatively, the first bottom surface) of the first carrier, and the second carrier has a second top surface and a second bottom surface, and the second lace-receiving portion is secured to the second top surface (or, alternatively, the second bottom surface) of the second carrier. The first and second bottom surfaces can face the external surface of the article of apparel.

In some embodiments, the first lace-receiving portion can form a first plurality of lower loop apertures and the second lace-receiving portion can form a second plurality of lower loop apertures, with the first and second plurality of lower loop apertures being configured to engage with one or more strands that extend from a sole structure of the article of footwear.

In other embodiments, at least a portion of the first lace-receiving portion and at least a portion of the second lace-receiving portion is covered by an external portion of an upper of the article of footwear. The first lace-receiving portion can extend from a first start end of the first lace element to a first intermediate portion of the first lace element and the first lacing portion can extend from the first intermediate portion to a first terminal end of the first lace element, and the second lace-receiving portion can extend from a second start end of the second lace element to a second intermediate portion of the second lace element and the second lacing portion can extend from the second intermediate portion to a second terminal end of the second lace element.

In another embodiment, an article of apparel can include an opening in the article of apparel, a first continuous lace element having a first lace-receiving portion and a first lacing portion, the first lace-receiving portion being secured to a first side of the opening in the article of apparel, and a second continuous lace element having a second lace-receiving portion and a second lacing portion, the second lace-receiving portion being secured to a second side of the opening in the article of apparel. The first lace-receiving element can form a first plurality of loop apertures extending toward the second side, and the second lace-receiving portion can form a second plurality of loop apertures extending toward the first side. The first lacing portion can engage with respective ones of the first plurality of loop apertures and respective ones of the second plurality of loop apertures, and the second lacing portion can engage with respective ones of the first plurality of loop apertures and respective ones of the second plurality of loop apertures. The article of apparel can be an article of footwear and the opening can be an opening in an upper of the article of footwear.

In some embodiments, the first lace-receiving element and the second lace-receiving element are directly secured to an external surface of the article of apparel. Alternatively, the first lace-receiving element can be secured to a first carrier and the second lace-receiving element can be secured to a second carrier, and the first carrier and the second carrier can be secured to an external surface of the article of apparel.

The first and second plurality of loop apertures can form a plurality of pairs of loop apertures that extend along the first and second sides of the opening, such as a plurality of pairs of loop apertures that symmetrically aligned with from two to ten pairs.

The first carrier and second carrier can comprise elongated strips of material. The first carrier can a first top surface and a first bottom surface, and the first lace-receiving portion can be secured to the first top surface (or alternatively, the first bottom surface) of the first carrier. Similarly, the second carrier can have a second top surface and a second bottom surface, and the second lace-receiving portion can be secured to the second top surface (or alternatively, the second bottom surface) of the second carrier. The first and second bottom surfaces can face the external surface of the article of apparel.

In some embodiments, the first lace-receiving portion can form a first plurality of lower loop apertures and the second lace-receiving portion can form a second plurality of lower loop apertures, with the first and second plurality of lower loop apertures being configured to engage with one or more strands that extend from a sole structure of the article of footwear.

In yet another embodiment, a method of manufacturing an article of apparel is provided. The method can include securing a first lace-receiving portion of a first lace element to a first side of an opening in the article of apparel, with the first lace-receiving element forming a first plurality of loop apertures, securing a second lace-receiving portion of a second lace element to a second side of the opening in the article of apparel, with the second lace-receiving portion forming a second plurality of loop apertures, engaging a first lacing portion of the first lace element with respective ones of the first plurality of loop apertures and respective ones of the second plurality of loop apertures so that the first lacing portion extends laterally across the opening along at least a portion of a length of the opening, and engaging a second lacing portion of the second lace element with respective ones of the first plurality of loop apertures and respective ones of the second plurality of loop apertures so that the second lacing portion extends laterally across the opening along at least a portion of the length of the opening. The article of apparel can be an article of footwear and the opening can be an opening in an upper of the article of footwear.

In some embodiments, the first lace-receiving element and the second lace-receiving element can be directly secured to an external surface of the article of apparel. Alternatively, the first lace-receiving element can be secured to a first carrier and the second lace-receiving element can be secured to a second carrier, and the first carrier and the second carrier can be secured to an external surface of the article of apparel.

The first and second plurality of loop apertures form a plurality of pairs of loop apertures that extend along the first and second sides of the opening, such as a plurality of pairs of loop apertures that are symmetrically aligned, and the number of the plurality of pairs of loop apertures ranges from 2 to 10.

In some embodiments, the first carrier and second carrier can comprise elongated strips of material. The first carrier can have a first top surface and a first bottom surface, and the first lace-receiving portion can be secured to the first top surface (or alternatively, the first bottom surface) of the first carrier, and the second carrier can have a second top surface and a second bottom surface, and the second lace-receiving portion can be secured to the second top surface (or alternatively, the second bottom surface) of the first carrier. The first and second bottom surfaces can face the external surface of the article of apparel.

In some embodiments, the first lace-receiving portion forms a first plurality of lower loop apertures and the second lace-receiving portion forms a second plurality of lower loop apertures, the first and second plurality of lower loop apertures are configured to engage with one or more strands that extend from a sole structure of the article of footwear. At least a portion of the first lace-receiving portion and at least a portion of the second lace-receiving portion can be covered by an external portion of an upper of the article of footwear.

The first lace-receiving portion can extend from a first start end of the first lace element to a first intermediate portion of the first lace element and the first lacing portion can extend from the first intermediate portion to a first terminal end of the first lace element, and the second lace-receiving portion can extend from a second start end of the second lace element to a second intermediate portion of the second lace element and the second lacing portion can extend from the second intermediate portion to a second terminal end of the second lace element.

In yet another embodiments, a method of forming a lacing system for attachment to an article of apparel is provided. The method can include securing a first lace-receiving portion of a first lace element to a first carrier, with the first lace-receiving element forming a first plurality of loop apertures, and securing a second lace-receiving portion of a second lace element to a second carrier, with the second lace-receiving portion forming a second plurality of loop apertures. The first lace element can comprise a lacing portion that extends away from the first carrier to engage with respective ones of the first plurality of loop apertures and respective ones of the second plurality of loop apertures such that the first lacing portion can extend laterally across a lacing gap between the first and second carrier, and the second lace element can comprise a second lacing portion that extends away from the second carrier to engage with respective ones of the first plurality of loop apertures and respective ones of the second plurality of loop apertures such that the second lacing portion can extend laterally across the lacing gap between the first and second carrier.

In some embodiments, the first and second plurality of loop apertures can form a plurality of pairs of loop apertures, such as from two to ten pairs of loop apertures. The plurality of pairs of loop apertures can be symmetrically aligned along a length of the lacing system.

The first carrier can be an elongated strip of material that extends along a first side of the lacing gap, and the second carrier can be an elongated strip of material that extends along a second side of the lacing gap. The first carrier and the second carrier can have a rectangular shape.

In some embodiments, the first lace-receiving portion can be stitched to the first carrier, and the second lace-receiving portion can be stitched to the second carrier. In other embodiments, the first lace-receiving portion can be alternatively, or additionally, adhesively bonded to the first carrier and the second lace-receiving portion can be alternatively, or additionally, adhesively bonded to the second carrier.

General Considerations

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." The term "lateral direction" or "transverse direction" refers to a side-to-side direction extending along a width of a component. In other words, the lateral direction may extend between a medial side and a lateral side of an article of footwear. The "interior" of an article of footwear such as a shoe refers to space that is occupied by a wearer's foot when the shoe is worn. The "inner side" or "inner surface" of a upper or other footwear element refers to the face of that element that is oriented toward the shoe's interior in a completed article of footwear. The "exterior," "outer side," or "outer surface" of an element refers to the face of that element that is oriented away from the shoe's interior in the completed article of footwear.

In some embodiments, an article of footwear with a lacing system is disclosed. An individual skilled in the relevant art will appreciate, therefore, that the concepts disclosed herein apply to a wide variety of footwear styles, in addition to the specific style discussed in the following material and depicted in the accompanying figures. In the current embodiments, the article of footwear is shown in the form of an athletic shoe, such as a running shoe. However, in other embodiments, the disclosed lacing system can be used with any other kind of footwear including, but not limited to, hiking boots, soccer shoes, football shoes, sneakers, running shoes, cross-training shoes, rugby shoes, baseball shoes as well as other kinds of shoes. The exemplary article of footwear is a low-top style. In other embodiments, the article of footwear may be a high-top or other style. Moreover, in some embodiments the lacing systems can be configured for use with various kinds of non-sports-related footwear, including, but not limited to, dress shoes, slippers, loafers as well as any other kinds of footwear.

Articles of footwear are a subset of articles of apparel and the exemplary lacing systems can be used with articles of apparel other than articles of footwear. For example, in some embodiments, the lacing systems and/or components disclosed herein can be used with any articles of apparel that require, or can benefit from, a closure mechanism to provide and/or restrict access to an interior of the article. For example, other kinds of articles of apparel to which the exemplary lacing systems can be used include clothing, such as pants, shorts, shirts, dresses, sweaters, hooded sweatshirts, and other sportswear or clothing items. Such lacing systems can be used as an alternative to other conventional lacing systems or other closure systems, such as zippers, buckles, straps, hook and loop-type closures, etc.

As used herein, the term "lacing component," "lacing element," or "lace" refers to an elongated structure extending continuously between a first end and a second end, capable of routing through lace-receiving passages (e.g., loop apertures) as described herein, and capable of withstanding a tensile load and includes, but is not limited to, a cable, a strand, a wire, a cord, a thread, or a string, among others. As used herein, an "end" of a lace includes a terminal end of a lace and some portion of the lace at the terminal end, such as for applying a pulling force on the lace, as will be well understood by those skilled in the art.

As used herein, the term "fixedly attached" refers to two components that are joined in a manner such that the two components may not be readily separated (for example, without damaging or destroying one or both of the components).

Although the figures may illustrate an article of footwear intended for use on only one foot (e.g., a right foot) of a wearer. One skilled in the art will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

Various lacing systems and methods of manufacturing the same are disclosed herein.

FIG. 1 illustrates an exemplary lacing system 100 for use with an article of apparel. The article of apparel can be any article of apparel that can utilize a closure system, including, for example, pants, shorts, shirts, dresses, sweaters, hooded sweatshirts, footwear, and other sportswear or clothing items. The lacing systems provided herein can be used as an alternative to other conventional lacing systems or other closure systems, such as zippers, buckles, straps, hook and loop-type closures.

In certain embodiments, the article of apparel is an article of footwear and the lacing system 100 can be incorporated into an upper of the article of footwear to selectively change the size of an ankle opening and to permit the wearer to modify certain dimensions of the upper (e.g., girth) to allow a foot to be received and secured within the void.

The lacing system can comprise a first lace element 102 (also referred to herein as first tensile component 102) and a second lace element 104 (also referred to herein as first tensile component 104). Each lace element 102, 104 can be formed from a continuous lacing element (e.g., a cord, strip, or other long, narrow piece of material). Examples of various materials that could be used include, but are not limited to, cotton, jute, hemp, natural leather, synthetic leather, textiles, polymer sheets or strips, as well as other types of natural or synthetic materials. In some cases, the material may be a woven or knitted textile material. In other cases, the material may be a plastic or polymer material. In one embodiment, lace elements 102, 104 can be made of a generally inelastic material that resists stretching. In some cases, lace elements 102, 104 can include elastic portions. Furthermore, lace elements 102, 104 can comprise a single strand of material or multiple strands of material. Additionally, lace elements 102, 104 may be coated with a material along their length, or a portion thereof, to increase friction in order to keep the lace fastened.

Each lace element 102, 104 can have two ends. For example, as shown in FIG. 1, first lace element 102 has a first start end 106 and a first terminal end 108, and second lace element 104 has a second start end 110 and a second terminal end 112. First and second terminal ends 108, 112 can include an aglet. The aglet can be, for example, a small sheath of plastic, metal, or other materials that provide an improved gripping surface for the wearer.

First lace element 102 can have a first lace-receiving portion 114 and a first lacing portion 116. Second lace element 104 can have a second lace-receiving portion 118 and a second lacing portion 120. The lace-receiving portions transition to lacing portions at an intermediate portion of both the first and second lace elements as shown in FIG. 1.

In some embodiments, first lace-receiving portion 114 can be secured to a first carrier 122, the second lace-receiving portion 118 can be secured to a second carrier 124. The first and second lacing portions 116, 120 are not attached to either of the first or second carrier 122, 124, so that the first and second lacing portions 116, 120 are each freely movable relative to the first and second carriers 122, 124.

As used herein, the term "carrier" refers to a supporting structure to which the lace-receiving portions can be secured, which can, in turn or concurrently, be secured to an article of apparel, such as an article of footwear or clothing. For example, first and second carriers 122, 124 can be formed from a textile, a natural fabric, a synthetic fabric, a knit, a woven material, a nonwoven material, a mesh, a leather, a synthetic leather, a polymer, a rubber, and a foam, or any other suitable apparel material, as well as any combination of the same. The carrier can be flexible, rigid, or semi-rigid (i.e., a material that is stiff and solid, but not inflexible). In addition, the carriers can include one or more layers of material, either the same material or a different material, as well as one or more coatings or films applied to one or more surfaces of the carriers.

As shown in FIG. 1, first lace-receiving portion 114 can be secured to the first carrier 122 to provide a first plurality of loop apertures 126 and second lace-receiving portion 118 can be secured to the second carrier 124 to provide a second plurality of loop apertures 128. First and second carriers 122, 124 are spaced apart to provide a lacing gap 130 therebetween, with the first carrier 122 on a first side 132 and the second carrier 124 on the second side 134.

As used herein, the term "loop aperture" refers to any closed structure that forms an aperture (or lace-receiving passage) that can receive a lace associated with a lacing system, with the closed structure being formed, at least in part, by the lace-receiving portion of a lace element. In some embodiments, the aperture can be defined by a combination of a respective carrier and a portion of the lace-receiving element.

When formed with a flexible lace-receiving portion of the lace element, the shape of a "loop aperture" can change depending on an amount of tension applied to the loop aperture by a lace element. Alternatively, the lace-receiving portion of a lace element can be formed from a rigid material. For example, the lace-receiving portion can comprise a different material from a flexible lacing portion of the lace element, or a flexible material of the lace element can be coated and/or covered by a rigid material in the lace-receiving portion of the lace element. When formed from a rigid material, the shape of the loop aperture can be generally fixed and can be any desired shape (e.g., flat, curved, angled).

In the embodiment shown in FIG. 1, carriers 122, 124 are elongated strips of material that extend along a length 136. Length 136 can vary depending on the number of loop apertures desired on each side. Thus, for example, a shorter length may be suitable for a smaller number of aperture pairs (e.g., 2-6) while a longer length maybe desired for a larger number of aperture pairs (e.g., 7-20). In some embodiments, the number of pairs of lace apertures can be greater than 2, such as from 2 to 20, or from 2 to 10, or from 4 to 8.

The shape of carriers 122, 124 can also vary. For example, although FIG. 1 illustrates a rectangular shape, any other shape that can receive the lace-receiving portions thereon, or at least a portion thereof, may be suitable for securing the lace-receiving portion.

As shown in FIG. 1, the lacing portions 116, 120 can engage with the loop apertures 126, 128 to establish the closure mechanism of the lacing system 100. In particular, each of the lacing portions 116, 118 can extend back and forth (e.g., in the lateral direction) across the lacing gap 130 to engage with one or both of the first plurality of loop apertures 126 on the first side 132 and the second plurality of loop apertures 128 on the second side 134.

In the embodiment shown in FIG. 1, the first lacing portion 116 extends in a lateral direction from a distal end of the first carrier 122 (i.e., front) to engage with one of the second plurality of loop apertures 128, back in the lateral direction to engage with one of the first plurality of loop apertures 126, and back again in the lateral direction with one of the second plurality of loop apertures 128, and so on. Similarly, the second lacing portion 120 extends in a lateral direction from a distal end of the second carrier 124 (e.g., towards the front) to engage with one of the first plurality of loop apertures 126, back in the lateral direction to engage with one of the second plurality of loop apertures 128, and so on. After the first and second lacing portions 116, 120 engage with the last desired one of the respective first and second plurality of loop apertures 126, 128 on the first and second carriers 122, 124 (e.g., towards the rear), the first and second terminal ends 108, 112 can be manipulated to tie the remaining portions of the first and second lacing portions 116, 120 together in any desired conventional tying manner.

Lace-receiving portions 114, 118 can be secured to the respective carrier 122, 124 by any suitable manner that results in the two components being fixedly attached. In the embodiment shown in FIG. 1, the lace-receiving portions 114, 118 are secured to the carriers 122, 124 by one or more stitches 138 that extend along the lengths 136 of the carriers 122, 124. In addition to, or alternatively, lace-receiving portions 114, 118 can be secured to the carriers 122, 124 by any other suitable manner, such as by permanent adhesives, rivets, staples, welding, or thermal bonding.

Figure 2:
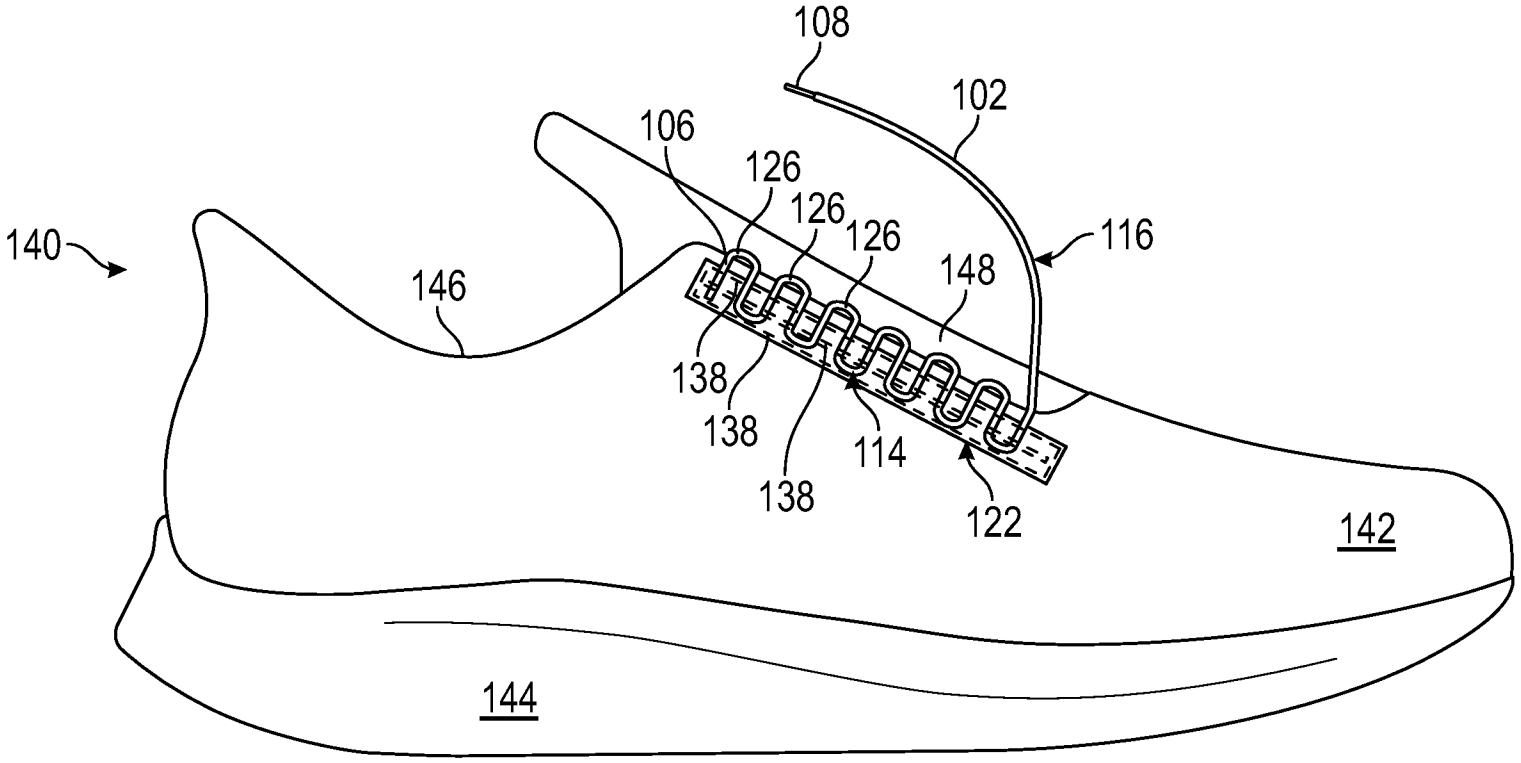
FIG. 2 illustrates a portion of the lacing system shown in FIG. 1 on an article of apparel.
Figure 3:
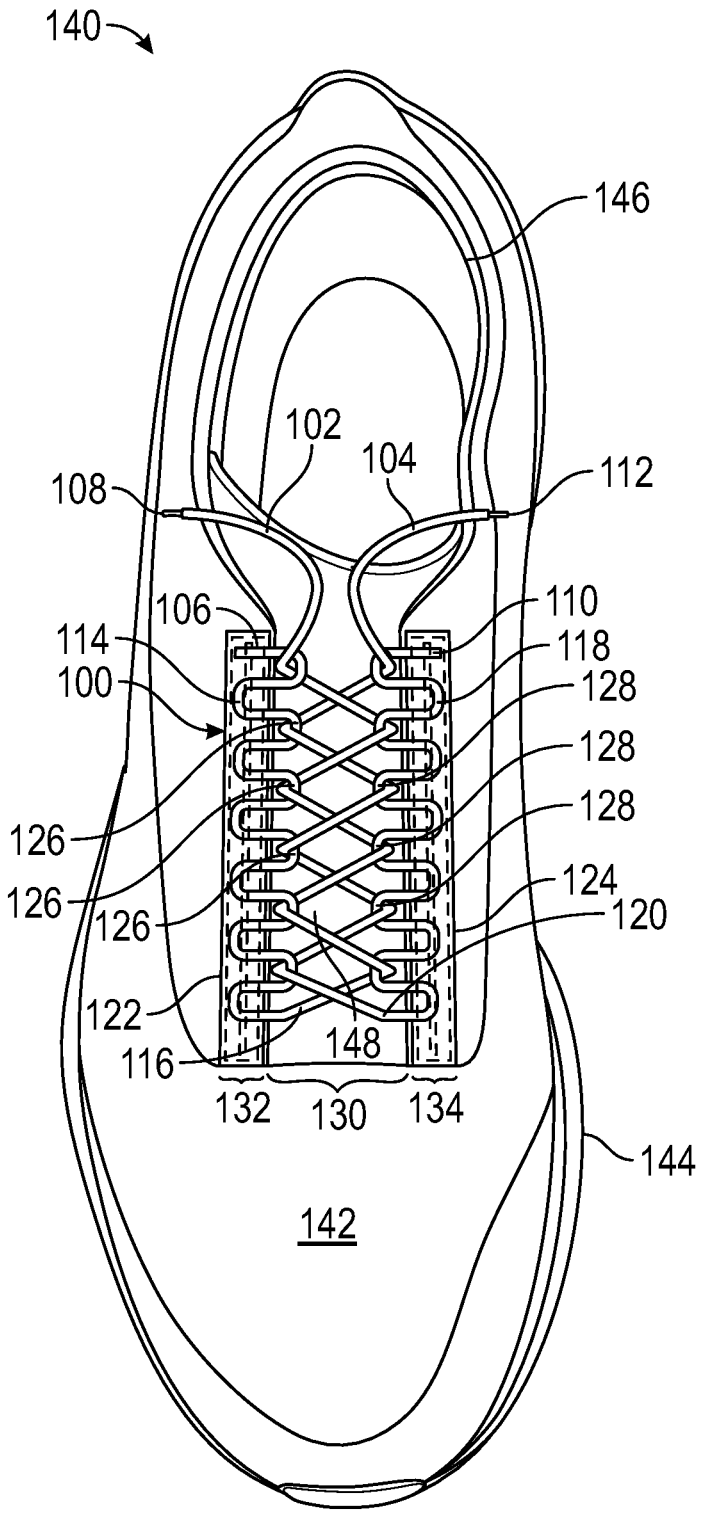
FIG. 3 illustrates the lacing system shown in FIG. 1 on an article of apparel.

FIG. 2 illustrates first lace element 102 and first carrier 122 secured to an article of footwear 140 (shown without the second lace element 104 and second carrier 124 for convenience). FIG. 3 illustrates the lacing system 100 secured to the article of footwear 140. Like the attachment of the lace-receiving portions 114, 118, the lacing system can be fixedly attached to the article of footwear in any suitable manner including stitching, permanent adhesives, rivets, staples, welding, or thermal bonding.

As shown in FIGS. 2 and 3, the article of footwear 140 can comprise an upper 142 and a sole structure 144. Generally, upper 142 may be any type of upper. In particular, upper 142 may have any design, shape, size, and/or color. For example, in embodiments where the article of footwear 140 is a basketball shoe, upper 142 could be a high-top upper that is shaped to provide high support on an ankle. In embodiments where article 140 is a running shoe, upper 142 could be a low-top upper as shown in FIG. 2.

Upper 142 may include one or more material elements (for example, meshes, textiles, foam, leather, and synthetic leather), which may be joined to define an interior cavity configured to receive a foot of a wearer. The material elements may be selected and arranged to impart properties such as light weight, durability, air permeability, wear resistance, flexibility, and comfort. Upper 142 may define an opening 146 (i.e., an ankle opening) through which a foot of a wearer may be received into the interior cavity.

Lacing system 100 can allow the article of footwear 140 to move between an expanded, loose, unsecured, or open state, where the user's foot can be inserted or removed from the foot-receiving cavity of the article 140, and a contracted, secured, closed, or tightened state, where the user's foot is secured within the foot-receiving cavity by the lacing system 100. The lacing systems described herein can also be referred to as a tensioning system or fastening system as it is configured to tighten the upper around a foot received in the foot-receiving cavity.

In some embodiments, the article of footwear can include a tongue 148 disposed generally under and between the portions of the upper 142 including the lace-receiving portions 114, 118 of the lacing system 100, so that the lacing gap 130 extends generally over the tongue 148.

FIGS. 1 and 3 illustrates a symmetrical relationship between opposing loop apertures 126, 128. That is, for each of the first plurality of loop apertures 126, there is an opposing, aligned, one of the second plurality of loop apertures 128. In other embodiments, however, opposing loop apertures need not be aligned in a symmetrical manner. Thus, for example, one or more of the first plurality of loop apertures 126 could be linearly offset from respective ones of the second plurality of loop apertures 128.

Figure 4:
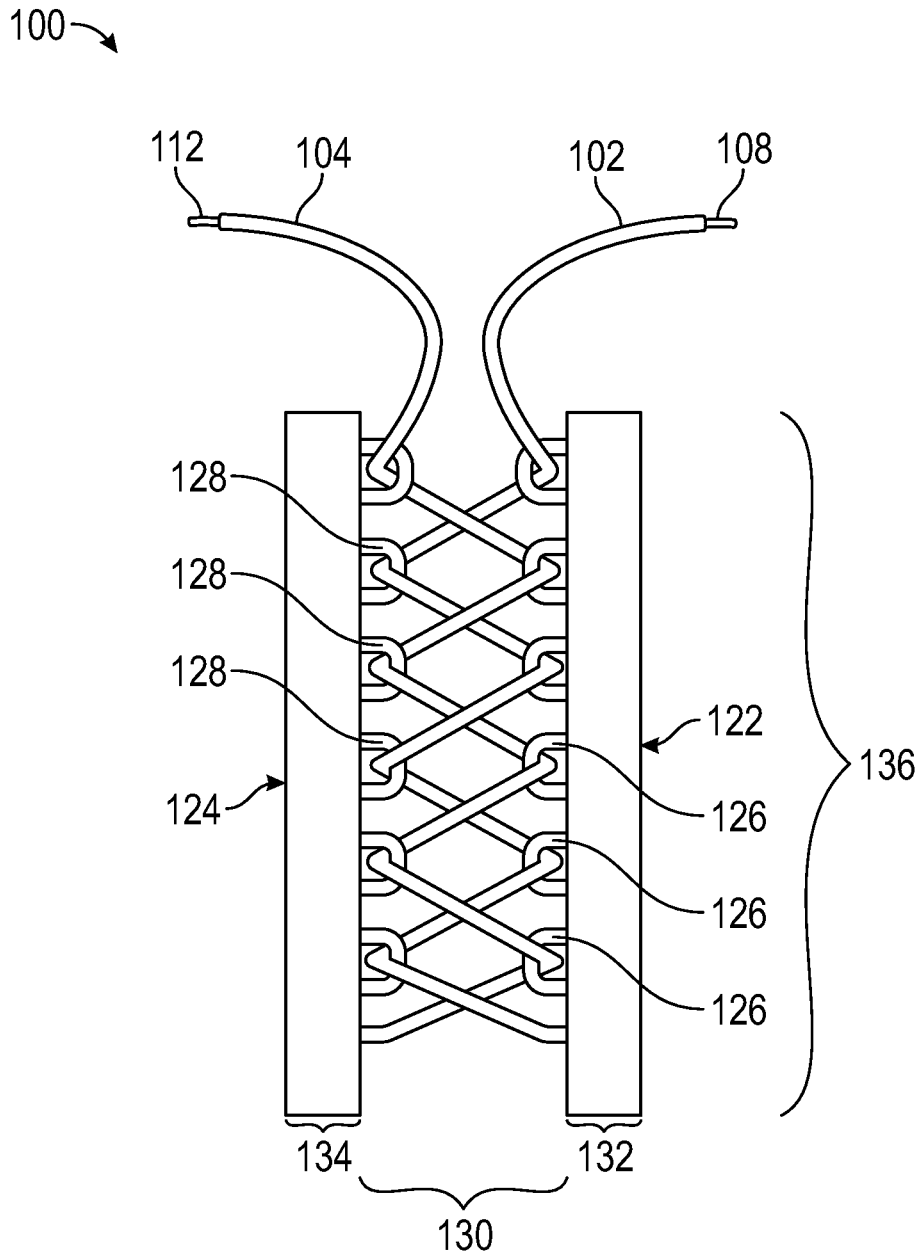
FIG. 4 illustrates another exemplary lacing system.
Figure 5:
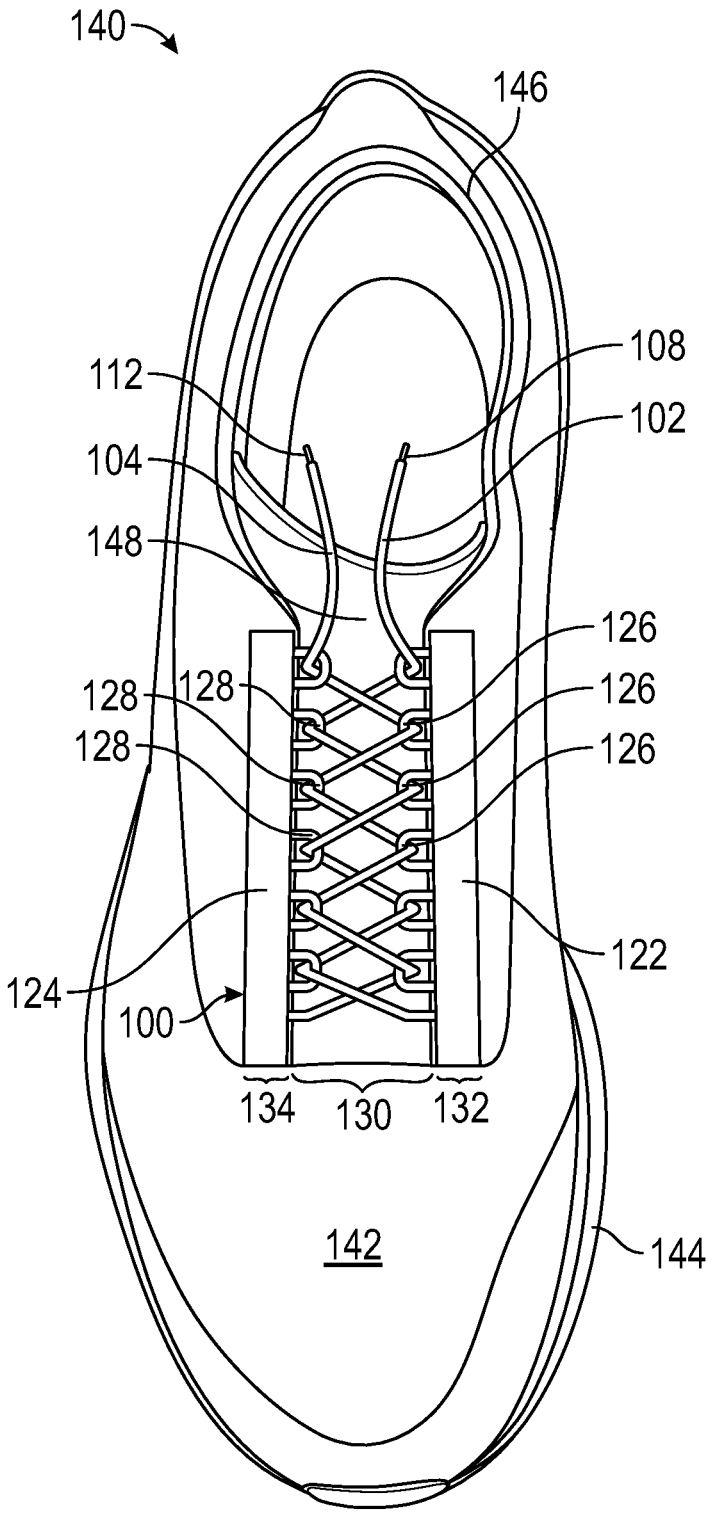
FIG. 5 illustrates the lacing system shown in FIG. 2 on an article of apparel.

FIG. 4 illustrates another embodiment of the lacing system 100. In this embodiment, the structure of the lacing system 100 is inverted so that the carriers 122, 124 shown in FIG. 1 are flipped and shown with the lace-receiving portions 114, 118 under their respective carrier 122, 124. For convenience, FIG. 4 uses the same numbering convention as FIG. 1; however, it should be understood that the first side 132 and second side 134 are now reversed. Thus, for example, as shown in FIG. 5, when attached to the article of footwear 140, the first side 132 is on the medial side of the article, while the second side 134 is on the lateral side of the article. This is in contrast to the position of each side on the article of footwear 140 shown in FIG. 3, where the first side 132 is on the lateral side of the article the second side 134 is on the medial side of the article. Of course, for articles of footwear that correspond to the other foot from that shown in FIGS. 3 and 5, the position of the first and second sides 132, 134 will also vary.

Thus, the embodiment of FIG. 5 varies from that of FIG. 2 in that the carriers 122, 124 cover at least a portion of the respective lace-receiving portions 114, 118, when the lacing system 100 is fixedly attached to the article of footwear 140.

Figure 6:
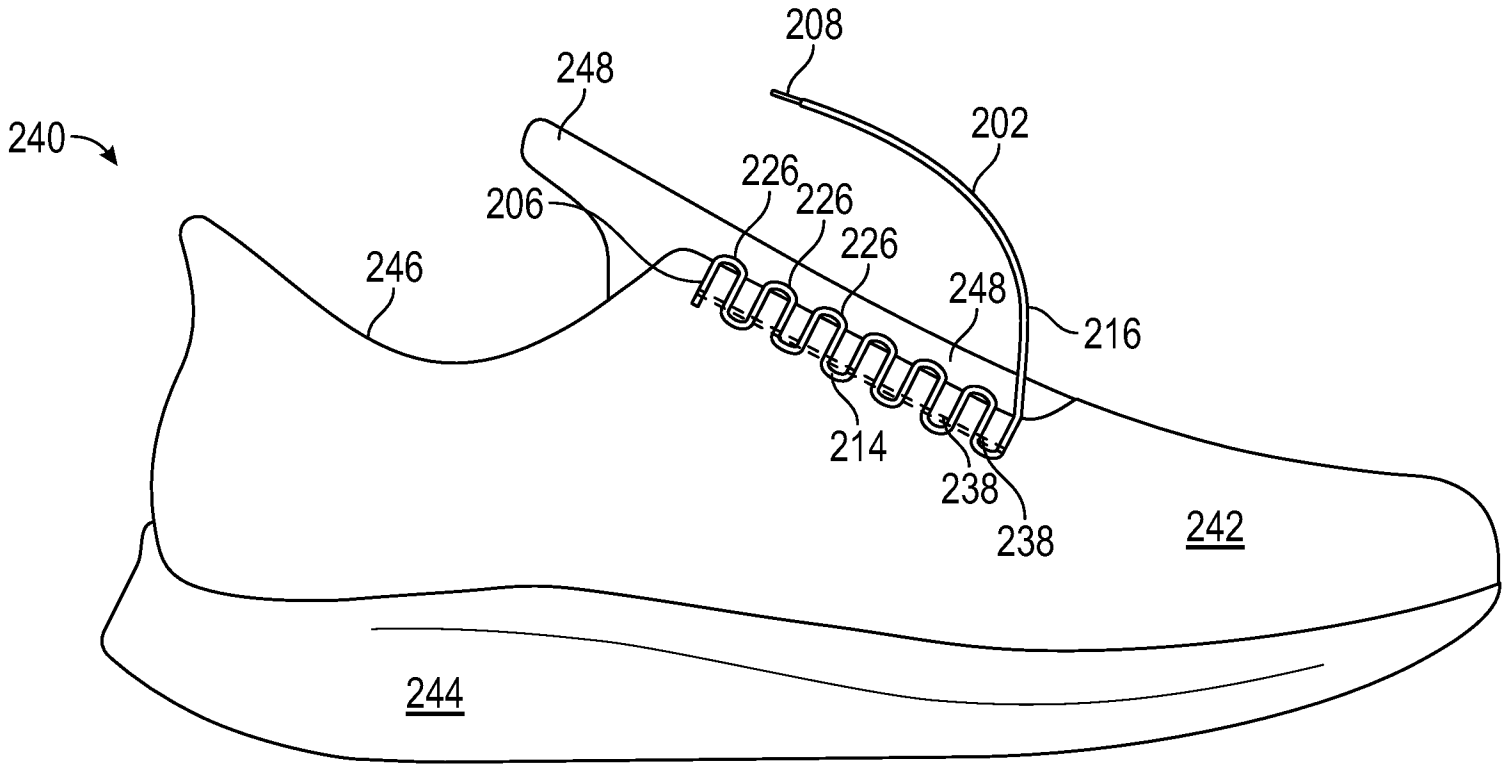
FIG. 6 illustrates a portion of an exemplary lacing system on an article of apparel.
Figure 7:
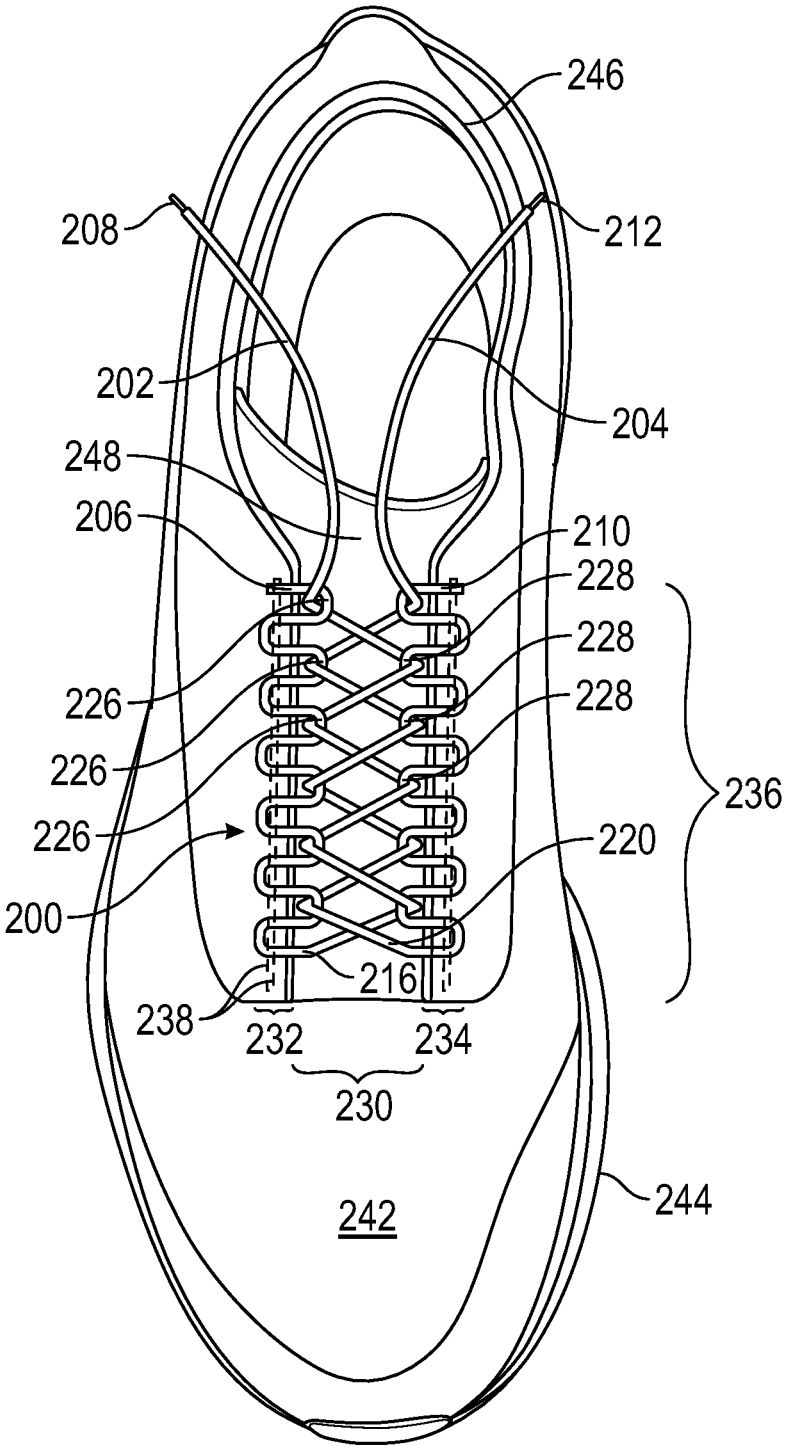
FIG. 7 illustrates the lacing system shown in FIG. 6 on an article of apparel.

FIGS. 6 and 7 illustrate another embodiment of a lacing system 200, in which lace-receiving portions 214, 218 are not secured to a carrier, but are instead secured directly to an article of footwear 240. For convenience, similar reference characters in FIGS. 6 and 7 denote similar elements that were labeled in FIGS. 2 and 3.

FIG. 6 illustrates a first lace element 202 secured to an article of footwear 240 (shown without a second lace element 204 for convenience). FIG. 7 illustrates the lacing system 200 secured to the article of footwear 240. The article of footwear 240 comprise an upper 242 and a sole structure 244.

As shown in FIGS. 6 and 7, the first lace-receiving portion 214 of the first lace element 202 can be secured directly to the upper 242, and as shown in FIG. 7, the second lace-receiving portion 218 of the second lace element 204 can be secured directly to the upper 242.

As in the previous embodiments, a first plurality of loop apertures 226 and a second plurality of loop apertures 228 are formed by the first and second lace-receiving portions 214, 218 and the first and second lacing portions 216, 220 can interact and engage with the loop apertures of the lacing system 200 to open the lacing system (e.g., by lowering tension in lacing portions) and close the lacing system (e.g., by increasing tension in the lacing portions), as described herein.

As discussed above, FIGS. 6 and 7 illustrate lace-receiving portions 214, 218 fixedly attached to the upper, such as by one or more stitches 238 that extend along the length 236 of the lace-receiving portions across a portion of the upper 242. In addition to, or alternatively, lace-receiving portions 214, 218 can be secured to directly to the upper by other suitable manner, such as by permanent adhesives, rivets, staples, welding, or thermal bonding.

Functionally, lacing system 100 and 200 operate in the same general manner. By applying tension to the terminal ends 208, 212 of the lace elements 202, 204, the lacing portions 216, 220 engage with the loop apertures 226, 228 and the lace gap 230 decreases causing the lacing system to move to a closed position.

Figure 8:
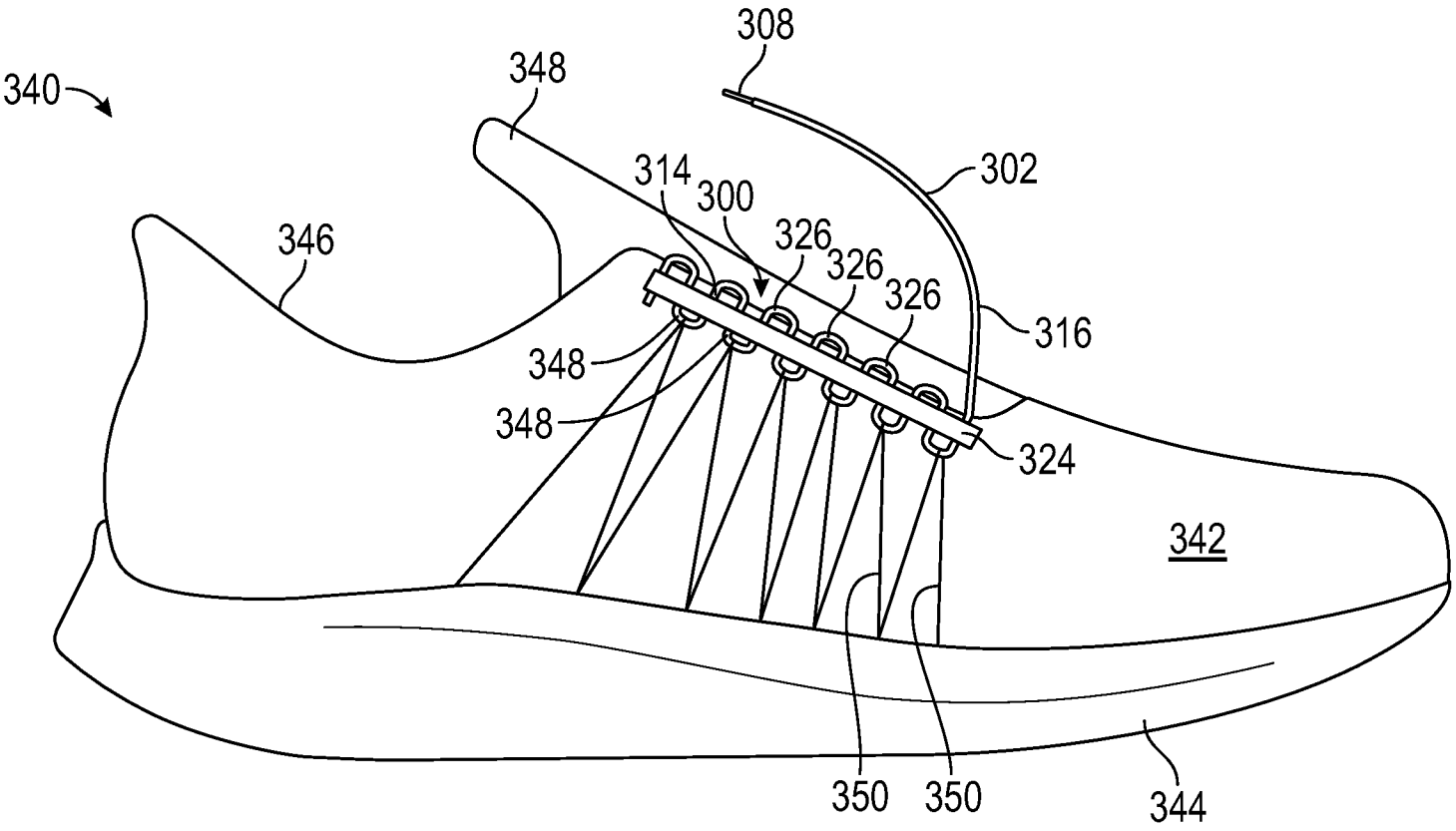
FIG. 8 illustrates another exemplary lacing system on an article of apparel.

FIG. 8 illustrates another embodiment in which lace-receiving portion 314 of the lacing system 300 is configured to engage with additional structural components of the article of footwear 340. In particular, the lace-receiving portion 314 can be secured to a carrier 324, which is in turn secured to the upper 342. However, in addition to providing a first plurality of apertures 326, the lace-receiving portion 314 includes engagement regions on a side of the carrier 324 that is opposite that of the loop apertures 326.

For example, as shown in FIG. 8, the lace-receiving portion 314 can include one or more engagement regions that are configured to receive, and/or engage with, one or more strands that extend from a lower area of the article of footwear 340. In FIG. 8, the engagement regions comprise a plurality of lower loop apertures 348 that can engage with one or more strands 350 that alternately extend towards and away from the sole structure 344.

During walking, running, or other activities, the movement of a foot within the article of footwear 340 can cause the upper 342 to stretch. Additionally, the tension applied by lacing system 300 can cause the upper 342 to stretch. The engagement of one or more stands 350 with the lower loop apertures 348 can help resist the stretching of the upper 342. Although strands 350 may also stretch, strands 350 generally stretch to a lesser degree than the other material elements forming upper 342. Each of strands 350 may be located, therefore, to form structural components in upper 342 that resist stretching in specific directions or reinforce locations where forces are concentrated. In some embodiments, a single strand 350 can extend and engage with the plurality of lower loop apertures. In other embodiments, a plurality of strands can be used, with each strand secured to the article of footwear in at least two locations. The strand(s) can be secured to the article of footwear 340 in any suitable location, such as at the junction of the upper 342 and sole structure 344.

The embodiment shown in FIG. 8 illustrates a similar carrier to that shown and described above with respect to FIG. 5; however, it should be understood that the engagement regions shown in FIG. 8 can be formed with any of the other lacing systems described herein. For example, lacing system 200 (FIG. 6) can also be formed with lower loop apertures, if desired, by securing the lace-receiving portions 214 to the upper 242 in a manner (e.g., stitching) that exposes lower loop apertures similar to those illustrated in FIG. 8.

Figure 9:
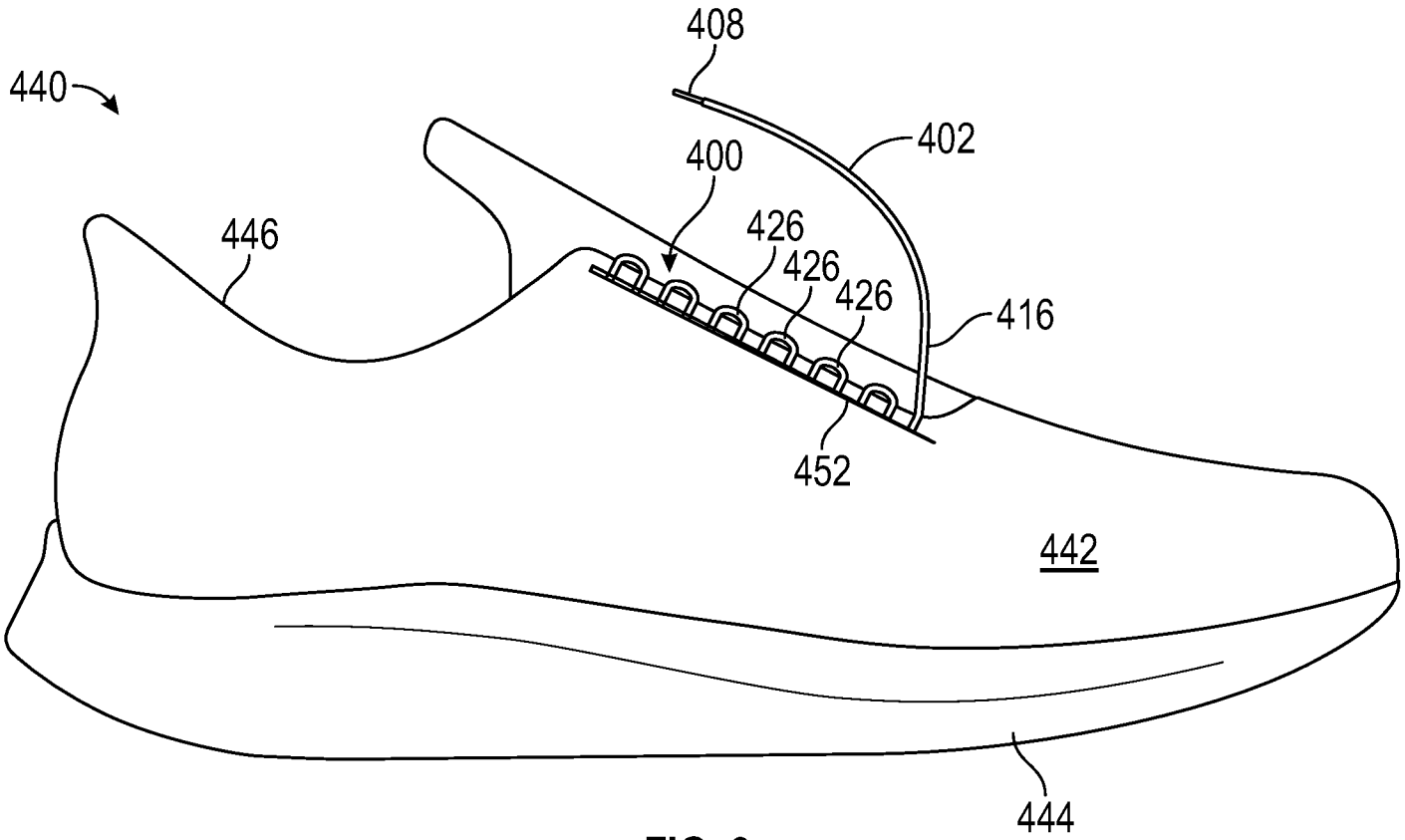
FIG. 9 illustrates another exemplary lacing system on an article of apparel.

FIG. 9 illustrates yet another embodiment of a lacing system 400 applied to an article of footwear 440. In FIG. 9, at least a portion of the lacing system 400 (such as a portion of the lace-receiving portions and/or a respective carrier, if provided) is covered by an external surface of the upper 442 and/or a cover layer that extends over some or all of the upper 442. In particular, the upper 442 and/or cover layer can have an aperture 452 through which the plurality of loop apertures 426 extend and are exposed for engagement with the lacing portions as described elsewhere herein.

As shown in FIG. 9, the lacing system 400 is partially obscured by the covering portion of the upper 442. However, it should be understood that any of the lacing systems described herein can be used. For example, lacing system 400 can be a lacing system with a carrier (e.g., FIGS. 1-5), a lacing system without a carrier (e.g., FIGS. 6-7), and/or a lacing system that has engagement regions for receiving and engaging with one or more strands (e.g., FIG. 8).

FIGS. 8 and 9 illustrate only one of the lace elements of a lacing system for convenience. However, it should be understood that the second lace element can be a mirror image of the first lace element and the arrangement and interaction of the two lace elements can be the same as that described in other embodiments herein.

Further aspects of the current disclosure are provided by the subject matter of the following clauses:

1. A lacing system for an article of apparel comprising:

a first lace element having an elongated structure that extends continuously between a first end and a second end, the first lace element having a first lace-receiving portion and a first lacing portion; a second lace element having an elongated structure that extends continuously between a first end and a second end, the second lace element having a second lace-receiving portion and a second lacing portion; a first carrier to which the first lace-receiving portion of the first lace element is fixedly attached; and a second carrier to which the second lace-receiving portion of the second lace element is fixedly attached, the second carrier being spaced apart from the first carrier by a lacing gap; wherein the first lace-receiving portion forms a first plurality of loop apertures, and the second lace-receiving portion forms a second plurality of loop apertures, and wherein the first lacing portion engages with respective ones of the first plurality of loop apertures and respective ones of the second plurality of loop apertures, and the second lacing portion engages with respective ones of the first plurality of loop apertures and respective ones of the second plurality of loop apertures.

2. The lacing system of claim 1, wherein the first and second plurality of loop apertures form a plurality of pairs of loop apertures.

3. The lacing system of claim 2, wherein the lacing system has at least two pairs of loop apertures.

4. The lacing system of claim 2, wherein the lacing system has from two to ten pairs of loop apertures.

5. The lacing system of any of claims 2-4, wherein the plurality of pairs of loop apertures are symmetrically aligned along a length of the lacing system.

6. The lacing system of any of the preceding claims, wherein the first carrier is an elongated strip of material that extends along a first side of the lacing gap, and the second carrier is an elongated strip of material that extends along a second side of the lacing gap.

7. The lacing system of any of the preceding claims, wherein the first carrier and the second carrier have a rectangular shape.

8. The lacing system of any of the preceding claims, wherein the first lace-receiving portion is stitched to the first carrier, and the second lace-receiving portion is stitched to the second carrier.

9. The lacing system of any of the preceding claims, wherein the first lace-receiving portion is adhesively bonded to the first carrier and the second lace-receiving portion is adhesively bonded to the second carrier.

10. The lacing system of any of the preceding claims, further comprising an article of apparel, wherein the first and second carriers are secured to an external surface of the article of apparel.

11. The lacing system of claim 10, wherein the first carrier has a first top surface and a first bottom surface, and the first lace-receiving portion is secured to the first top surface of the first carrier, the second carrier has a second top surface and a second bottom surface, and the second lace-receiving portion is secured to the second top surface of the second carrier, and the first and second bottom surfaces face the external surface of the article of apparel.

12. The lacing system of claim 10, wherein the first carrier has a first top surface and a first bottom surface, and the first lace-receiving portion is secured to the first bottom surface of the first carrier, the second carrier has a second top surface and a second bottom surface, and the second lace-receiving portion is secured to the second bottom surface of the second carrier, and the first and second bottom surfaces face the external surface of the article of apparel.

13. The lacing system of any of the preceding claims, wherein the article of apparel is an article of footwear.

14. The lacing system of claim 13, wherein the first lace-receiving portion forms a first plurality of lower loop apertures and the second lace-receiving portion forms a second plurality of lower loop apertures, the first and second plurality of lower loop apertures being configured to engage with one or more strands that extend from a sole structure of the article of footwear.

15. The lacing system of claim 13 or 14, wherein at least a portion of the first lace-receiving portion and at least a portion of the second lace-receiving portion is covered by an external portion of an upper of the article of footwear.

16. The lacing system of any of the preceding claims, wherein the first end of the first lace element is a first start end, the second end of the first lace element is a first terminal end, the first end of the second lace element is a second start end, and the second end of the second lace element is a second terminal end, wherein the first lace-receiving portion extends from the first start end of the first lace element to a first intermediate portion of the first lace element and the first lacing portion extends from the first intermediate portion to the first terminal end of the first lace element, and the second lace-receiving portion extends from the second start end of the second lace element to a second intermediate portion of the second lace element and the second lacing portion extends from the second intermediate portion to the second terminal end of the second lace element.

17. An article of apparel comprising: an opening in the article of apparel; a first continuous lace element having a first lace-receiving portion and a first lacing portion, the first lace-receiving portion being secured to a first side of the opening in the article of apparel; and a second continuous lace element having a second lace-receiving portion and a second lacing portion, the second lace-receiving portion being secured to a second side of the opening in the article of apparel; wherein the first lace-receiving element forms a first plurality of loop apertures extending toward the second side, and the second lace-receiving portion forms a second plurality of loop apertures extending toward the first side, and the first lacing portion engages with respective ones of the first plurality of loop apertures and respective ones of the second plurality of loop apertures, and the second lacing portion engages with respective ones of the first plurality of loop apertures and respective ones of the second plurality of loop apertures.

18. The article of apparel of claim 17, wherein the article of apparel is an article of footwear and the opening is an opening in an upper of the article of footwear.

19. The article of apparel of any of claims 17-18, wherein the first lace-receiving element and the second lace-receiving element are directly secured to an external surface of the article of apparel.

20. The article of apparel of any of claims 17-18, wherein the first lace-receiving element is secured to a first carrier and the second lace-receiving element is secured to a second carrier, and the first carrier and the second carrier are secured to an external surface of the article of apparel.

21. The article of apparel of any of claims 17-20, wherein the first and second plurality of loop apertures form a plurality of pairs of loop apertures that extend along the first and second sides of the opening.

22. The article of apparel of claim 21, wherein the plurality of pairs of loop apertures are symmetrically aligned, and the number of the plurality of pairs of loop apertures ranges from two to ten.

23. The article of apparel of claim 20, wherein the first carrier and second carrier comprise elongated strips of material.

24. The article of apparel of claim 20 or 23, wherein the first carrier has a first top surface and a first bottom surface, and the first lace-receiving portion is secured to the first top surface of the first carrier, the second carrier has a second top surface and a second bottom surface, and the second lace-receiving portion is secured to the second top surface of the second carrier, and the first and second bottom surfaces face the external surface of the article of apparel.

25. The article of apparel of claim 20 or 23, wherein the first carrier has a first top surface and a first bottom surface, and the first lace-receiving portion is secured to the first bottom surface of the first carrier, the second carrier has a second top surface and a second bottom surface, and the second lace-receiving portion is secured to the second bottom surface of the second carrier, and the first and second bottom surfaces face the external surface of the article of apparel.

26. The article of apparel of claim 18, wherein the first lace-receiving portion forms a first plurality of lower loop apertures and the second lace-receiving portion forms a second plurality of lower loop apertures, the first and second plurality of lower loop apertures being configured to engage with one or more strands that extend from a sole structure of the article of footwear.

27. A method of manufacturing an article of apparel comprising: securing a first lace-receiving portion of a first continuous lace element to a first side of an opening in the article of apparel, the first lace-receiving element forming a first plurality of loop apertures; securing a second lace-receiving portion of a second continuous lace element to a second side of the opening in the article of apparel, the second lace-receiving portion forming a second plurality of loop apertures; engaging a first lacing portion of the first continuous lace element with respective ones of the first plurality of loop apertures and respective ones of the second plurality of loop apertures so that the first lacing portion extends laterally across the opening along at least a portion of a length of the opening; and engaging a second lacing portion of the second continuous lace element with respective ones of the first plurality of loop apertures and respective ones of the second plurality of loop apertures so that the second lacing portion extends laterally across the opening along at least a portion of the length of the opening.

28. The method of claim 27, wherein the article of apparel is an article of footwear and the opening is an opening in an upper of the article of footwear.

29. The method of any of claims 27-28, wherein the first lace-receiving element and the second lace-receiving element are directly secured to an external surface of the article of apparel.

30. The method of any of claims 27-28, wherein the first lace-receiving element is secured to a first carrier and the second lace-receiving element is secured to a second carrier, and the first carrier and the second carrier are secured to an external surface of the article of apparel.

31. The method of any of claims 27-30, wherein the first and second plurality of loop apertures form a plurality of pairs of loop apertures that extend along the first and second sides of the opening.

32. The method of claim 31, wherein the plurality of pairs of loop apertures are symmetrically aligned, and the number of the plurality of pairs of loop apertures ranges from 2 to 10.

33. The method of claim 30, wherein the first carrier and second carrier comprise elongated strips of material.

34. The method of claim 30 or 33, wherein the first carrier has a first top surface and a first bottom surface, and the first lace-receiving portion is secured to the first top surface of the first carrier, the second carrier has a second top surface and a second bottom surface, and the second lace-receiving portion is secured to the second top surface of the second carrier, and the first and second bottom surfaces face the external surface of the article of apparel.

35. The method of claim 30 or 33, wherein the first carrier has a first top surface and a first bottom surface, and the first lace-receiving portion is secured to the first bottom surface of the first carrier, the second carrier has a second top surface and a second bottom surface, and the second lace-receiving portion is secured to the second bottom surface of the second carrier, and the first and second bottom surfaces face the external surface of the article of apparel.

36. The method of claim 28, wherein the first lace-receiving portion forms a first plurality of lower loop apertures and the second lace-receiving portion forms a second plurality of lower loop apertures, the first and second plurality of lower loop apertures being configured to engage with one or more strands that extend from a sole structure of the article of footwear.

37. The method of any of claims 28-36, wherein at least a portion of the first lace-receiving portion and at least a portion of the second lace-receiving portion is covered by an external portion of an upper of the article of footwear.

38. The method of any of claims 28-37, wherein the first lace-receiving portion a first start end of the first lace element to a first intermediate portion of the first lace element extends from and the first lacing portion extends from the first intermediate portion to a first terminal end of the first lace element, and the second lace-receiving portion extends from a second start end of the second lace element to a second intermediate portion of the second lace element and the second lacing portion extends from the second intermediate portion to a second terminal end of the second lace element.

39. A method of forming a lacing system for attachment to an article of apparel, comprising: securing a first lace-receiving portion of a first continuous lace element to a first carrier, the first lace-receiving element forming a first plurality of loop apertures; and securing a second lace-receiving portion of a second continuous lace element to a second carrier, the second lace-receiving portion forming a second plurality of loop apertures; wherein the first continuous lace element comprises a first lacing portion that extends away from the first carrier to engage with respective ones of the first plurality of loop apertures and respective ones of the second plurality of loop apertures such that the first lacing portion can extend laterally across a lacing gap between the first and second carrier, and wherein the second continuous lace element comprises a second lacing portion that extends away from the second carrier to engage with respective ones of the first plurality of loop apertures and respective ones of the second plurality of loop apertures such that the second lacing portion can extend laterally across the lacing gap between the first and second carrier.

40. The method of claim 39, wherein the first and second plurality of loop apertures form a plurality of pairs of loop apertures.

41. The method of claim 40, wherein the lacing system has from two to ten pairs of loop apertures.

42. The method of any of claims 40-41, wherein the plurality of pairs of loop apertures are symmetrically aligned along a length of the lacing system.

43. The method of any of claims 39-42, wherein the first carrier is an elongated strip of material that extends along a first side of the lacing gap, and the second carrier is an elongated strip of material that extends along a second side of the lacing gap.

44. The method of any of claims 39-43, wherein the first carrier and the second carrier both have a rectangular shape.

45. The method of any of claims 39-43, wherein the first lace-receiving portion is stitched to the first carrier, and the second lace-receiving portion is stitched to the second carrier.

46. The method of any of claims 39-43, wherein the first lace-receiving portion is adhesively bonded to the first carrier and the second lace-receiving portion is adhesively bonded to the second carrier.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An article of footwear comprising:

a first lace element having an elongated structure that extends continuously between a first end and a second end, the first lace element having a first lace-receiving portion and a first lacing portion, the first lace-receiving portion being secured to a first area of the article of footwear;

a second lace element having an elongated structure that extends continuously between a first end and a second end, the second lace element having a second lace-receiving portion and a second lacing portion, the second lace-receiving portion being secured to a second area of the article of footwear, a plurality of first loop apertures defined by the first lace-receiving portion; and a plurality of second loop apertures defined by the second lace-receiving portion.

2. The article of footwear of claim 1, wherein the first lacing portion engages with respective ones of both the first loop apertures and the second loop apertures, and the second lacing portion engages with respective ones of both the first loop apertures and the second loop apertures.

3. The article of footwear of claim 1, wherein the first area and the second area are surfaces of an upper of the article of footwear.

4. The article of footwear of claim 3, wherein the first lace-receiving portion and second lace-receiving portion are secured to the respective first and second areas by stitching.

5. The article of footwear of claim 3, wherein the first lace-receiving portion and second lace-receiving portion are secured to the respective first and second areas by an adhesive.

6. The article of footwear of claim 1, wherein the first area is a first carrier that is secured to an upper of the article of footwear, and the second area is a second carrier that is secured to the upper.

7. The article of footwear of claim 6, wherein the first lace-receiving portion and second lace-receiving portion are secured to the respective first and second areas by stitching.

8. The article of footwear of claim 6, wherein the first lace-receiving portion and second lace-receiving portion are secured to the respective first and second carriers by an adhesive.

9. The article of footwear of claim 1, wherein the plurality of first loop apertures and the plurality of second loop apertures form a plurality of pairs of loop apertures.

10. The article of footwear of claim 9, wherein the article of footwear has from two to ten pairs of loop apertures that are symmetrically aligned along a length of the article of footwear.

11. The article of footwear of claim 1, wherein the first lace-receiving portion is spaced apart from the second lacing portion by a lacing gap.

12. The article of footwear of claim 6, wherein the first lace-receiving portion is spaced apart from the second lacing portion by a lacing gap, and the first carrier is an elongated strip of material that extends along a first side of the lacing gap, and the second carrier is an elongated strip of material that extends along a second side of the lacing gap.

13. The article of footwear of claim 12, wherein the first carrier and the second carrier have a rectangular shape.

14. The article of footwear of claim 1, wherein the first lace-receiving portion forms a first plurality of lower loop apertures and the second lace-receiving portion forms a second plurality of lower loop apertures, the first and second plurality of lower loop apertures being configured to engage with one or more strands that extend from a sole structure of the article of footwear.

15. The article of footwear of claim 1, wherein at least a portion of the first lace-receiving portion and at least a portion of the second lace-receiving portion is covered by an external portion of an upper of the article of footwear.

16. The article of footwear of claim 1, wherein the first end of the first lace element is a first start end, the second end of the first lace element is a first terminal end, the first end of the second lace element is a second start end, and the second end of the second lace element is a second terminal end, wherein the first lace-receiving portion extends from the first start end of the first lace element to a first intermediate portion of the first lace element and the first lacing portion extends from the first intermediate portion to the first terminal end of the first lace element, and the second lace-receiving portion extends from the second start end of the second lace element to a second intermediate portion of the second lace element and the second lacing portion extends from the second intermediate portion to the second terminal end of the second lace element.

17. An article of footwear comprising:

a first lace element having an elongated structure that extends continuously between a first end and a second end of the first lace element, the first lace element having a first secured portion and a first unsecured portion, the first secured portion being attached to a surface of the article of footwear and defining a first plurality of loop apertures; and a second lace element having an elongated structure that extends continuously between a first end and a second end of the second lace element, the second lace element having a second secured portion and a second unsecured portion, the second secured portion being attached to a surface of the article of footwear and defining a second plurality of loop apertures.

18. The article of footwear of claim 17, wherein the first unsecured portion and the second unsecured portion is configured to engage with one or more of the first and second plurality of loop apertures to close an opening in an upper of the article of footwear.

19. The article of footwear of claim 17, wherein the first secured portion and the second secured portion are secured to one or more carriers that are secured to a surface of an upper of the article of footwear.

20. The article of footwear of claim 17, wherein the first secured portion and the second secured portion are secured to a surface of an upper of the article of footwear.

* * * * *